US010682847B2

(12) United States Patent
Guixeras Nogue et al.

(10) Patent No.: US 10,682,847 B2
(45) Date of Patent: Jun. 16, 2020

(54) ANILOX ROLLER CLEANING MACHINE BY LASER AND PROCEDURE FOR AUTO-ADJUSTING THE LASER FOCAL POINT TO THE DIAMETER OF THE ANILOX ROLLER

(71) Applicant: TEG TECHNOLOGIES RESEARCH AND DEVELOPMENT, S.L., Vilablareix (ES)

(72) Inventors: Lluis Guixeras Nogue, Vilablareix (ES); Rafael Guixeras Llora, Vilablareix (ES)

(73) Assignee: TEG Technologies Research and Development, S.L., Vilablareix (Gerona) (ES)

( * ) Notice: Subject to any disclaimer, the term of this patent is extended or adjusted under 35 U.S.C. 154(b) by 67 days.

(21) Appl. No.: 15/984,875

(22) Filed: May 21, 2018

(65) Prior Publication Data

US 2018/0354252 A1 Dec. 13, 2018

(30) Foreign Application Priority Data

Jun. 7, 2017 (ES) ..... 2636715

(51) Int. Cl.
*B41F 35/04* (2006.01)
*B41F 5/24* (2006.01)
(Continued)

(52) U.S. Cl.
CPC ..... *B41F 5/24* (2013.01); *B08B 7/0042* (2013.01); *B41F 35/001* (2013.01); *B41F 35/04* (2013.01);
(Continued)

(58) Field of Classification Search
CPC ..... B41F 35/04
(Continued)

(56) References Cited

U.S. PATENT DOCUMENTS 3,040,754 A * 6/1962 Lear, Sr. ..... B41C 1/00 134/147
5,592,879 A * 1/1997 Waizmann ..... B08B 7/0042 101/416.1
(Continued)

FOREIGN PATENT DOCUMENTS

DE 4427152 A1 2/1996
DE 102011013910 A1 9/2012
DE 102015110877 A 1/2017

*Primary Examiner* — Anthony H Nguyen
(74) *Attorney, Agent, or Firm* — Defillo & Associates; Evelyn A Defillo

(57) ABSTRACT

Disclosed is an anilox laser cleaning machine that includes: a multi-laser head with laser modules on a horizontal guide of a first movable support associated with the horizontal sliding carriage with the intermediation of brackets coupled to vertical micrometric axes associated with the horizontal sliding carriage controlled by servomotors. Each laser module includes: a laser resonator emitting a laser beam with a focal point in the vertical plane equidistant to the axes of rotation of the traction rollers of the anilox roller; and a vertical tube terminated in a nozzle oriented towards the focal point of the laser beam, connected to a suction source. The machine also includes a rotation detector with a palpate wheel contacting the surface of the anilox roller and associated with an encoder device connected to the electronic system of the machine that, in the absence of movement detection or irregular movement, activates the emergency stop.

3 Claims, 7 Drawing Sheets

(51) Int. Cl.
*B08B 7/00* (2006.01)
*B41F 35/00* (2006.01)

(52) U.S. Cl.
CPC ..... *B41P 2235/12* (2013.01); *B41P 2235/27* (2013.01)

(58) Field of Classification Search
USPC ..... 101/423
See application file for complete search history.

(56) References Cited

U.S. PATENT DOCUMENTS

| | | | | |
|---|---|---|---|---|
| 5,636,571 | A * | 6/1997 | Abrahamson | B41F 35/001 101/424 |
| 6,354,213 | B1 | 3/2002 | Jenkins | |
| 7,985,941 | B2 * | 7/2011 | Corrigan | B23K 26/0823 219/121.68 |
| 9,410,219 | B2 * | 8/2016 | Yoon | C21D 9/30 |
| 2008/0213978 | A1 * | 9/2008 | Henry | B08B 5/00 438/462 |
| 2015/0189891 | A1 * | 7/2015 | Haas | A21B 3/16 134/1.1 |
| 2016/0339487 | A1 * | 11/2016 | Higgins | B23K 26/352 |

* cited by examiner

ANILOX ROLLER CLEANING MACHINE BY LASER AND PROCEDURE FOR AUTO-ADJUSTING THE LASER FOCAL POINT TO THE DIAMETER OF THE ANILOX ROLLER

TECHNICAL FIELD

The present invention relates to the anilox roller of a flexographic printing machine, and more specifically to an operating procedure and improvements in a machine for cleaning the anilox roller by laser technology.

BACKGROUND OF THE INVENTION

Flexography is a printing technique that uses a flexible plate with relief called cliché, able to adapt to a number of supports or printing substrates very varied.

In this printing system, liquid inks characterized by their great drying speed are used. This high drying speed is what allows printing high volumes at low costs, compared with other printing systems.

Printers are usually rotary and the main difference between these and other printing systems is the way in which the cliché receives the ink. Generally, a rotating roller made of rubber or other materials, such as polyurethane or urethane, picks up the ink that is transferred to it by contact by another cylinder called anilox, with the intervention of a scraper that removes excess ink from the roller.

The anilox is made of chromed steel engraved mechanically or ceramic engraved by laser to have a surface with alveoli or holes of microscopic size with which it transfers a light layer of regular and uniform ink to the cliché. Subsequently, the cliché will transfer the ink to the medium to be printed.

Over time, microscopic-sized sockets or holes are covered with dry ink, which reduces the effectiveness of the roller, specifically the volume of the point, so it is necessary to periodically clean them.

Commonly, aniloxes are cleaned by three different techniques, solvent washing, soda blending and ultrasonic procedures. These have limited effectiveness.

Many inks are resistant to common solvents. Also, some solvents can not be used, due to their negative effect on the environment. In ceramic anilox, some solvents penetrate through the pores of the ceramic coating to attack the metal core of the roller so that the ceramic coating can be separated from the metal core. Cleaning with ultrasonics and soda can physically damage the ceramic itself.

As an alternative to the common anilox cleaning methods, a new method based on LASER cleaning of the anilox surface has been developed.

These devices are constituted by a mechanical structure that supports the anilox and a laser resonator. The mechanical structure rotates the anilox while the laser resonator separates and volatilizes the dry ink and debris deposited in microscopic-sized sockets or holes.

Various inventions for the cleaning and maintenance of anilox based on the laser scanning of its surface are currently known.

U.S. Pat. No. 6,354,213 describes an apparatus for cleaning an anilox roller that involves the use of a laser resonator and that comprises a first drive motor that rotates the anilox roller, a laser resonator slidably fixed in a guide projecting a laser beam; an expander of the laser beam; a lens orienting the expanded laser beam towards the surface of the anilox roll so that the slag contained in the alveoli is detached without affecting the ceramic or chromium coating; a blowing device directed towards the focal point of the laser beam that expels the loosened slag; a second drive motor that moves the laser resonator, beam expander and lens in the axial direction parallel to the longitudinal axis of the anilox roll; a bearing associated to the lens, which moves on the surface of the anilox roll, maintaining the appropriate distance so that the focal point of the laser beam hits the surface of the anilox roll.

DE4427152 describes an apparatus for cleaning anilox rollers comprising a laser resonator which, through an optical system, emits a laser beam towards a mirror that orientates it towards the anilox roller. The detached slag is removed through a suction hose.

The patent DE102011013910 describes an apparatus for cleaning anilox rolls that establishes a different operating scheme. In this case, a laser resonator emits a laser beam that is guided through optical fibers to several cleaning heads that impinge a fraction of the original beam against an area of the surface of the anilox.

The patent DE102015110877 describes an anilox roller cleaning apparatus by laser radiation, in which the beam of a laser resonator incise directly on the surface of the anilox roll, the slag being removed by a band impregnated in an adhesive element.

The cleaning capacity of these devices is much higher than that of conventional methods: washing with solvents, soda blasting and ultrasonic procedures, however, the operating time is longer, since it is necessary to make several passes or sweeps depending on the degree of anilox dirt.

The sweep speed of the laser beam is limited by the combination between the power of the resonator and the frequency of the emission. The higher the power, the greater the cleaning capacity, but at the same time the higher the temperature in the cleaning zone, which is why a limit is established from which the surface of the roller will be damaged. In the same way, more frequently, greater cleaning capacity, however, the cost of the resonator equipment increases considerably.

It would be beneficial and advisable to develop an anilox roll cleaning device that, with equal power and frequency of resonator, shortens the maneuver time.

Another problem in roll anilox laser cleaning systems is the adaptation of the focal length of beam to the diameter of the roll anilox to match the focal point on the surface of the cylinder. This adaptation is done in two ways. The first, manually by means of micrometric axes that allow to radially move the focal point of the laser beam with respect to the surface of the anilox roller. This system has the disadvantages of manual mechanical adjustments, derived from the wear of parts, misalignments by vibrations, etc.

The second way of adjustment is assisted, for which the device incorporates an electronic system in which the characteristics of the anilox roll are introduced through a user interface, so that a software program determines the appropriate coordinates of the focal point of the beam and drives a servomotor that moves it radially to the calculated position. This system has the disadvantage of the possibility of error in the data entry, which implies placing the focal point in wrong coordinates and consequently the low or null operability of the laser scan.

It would be beneficial to incorporate means of automatic adjustment of the focal point without intervention of the operator.

Another problem in anilox laser cleaning systems consists in the lack of means to determine if the anilox roller is rotating properly in its support bed. There have been cases in which, due to wear of the tractors of the roller, by jamming the axis of rotation, due to lack of alignment or irregularities in the surface of the anilox, this can rotate irregularly or even stop, thereby an overexposure of the surface of the anilox to the laser beam occurs, being irretrievably damaged.

It would be beneficial to incorporate security means that would stop the laser scan if the rotation of the anilox roller is irregular or stopped accidentally.

DESCRIPTION OF THE INVENTION

The present invention relates to a machine for cleaning anilox rolls and a method for auto-adjusting the laser focal point to the diameter of the anilox roll which, in view of the drawbacks described in the previous section, has the following advantages:

- For same resonator power and frequency, It reduces the operating times.
- Comprises safety means capable of stopping the cleaning operation when the rotation of the anilox is not stable or is stopped accidentally.
- It includes self-adjusting means of the laser focal point to the diameter of the anilox, avoiding the possibility of human error in its positioning.

The innovative laser anilox roller cleaning machine is made up of a mechanical structure that fixes all the elements of the machine and where the anilox roller is placed on a bed formed by two traction rollers and some free rollers, between which rest.

This mechanical structure has a multi-laser head constituted by two or more laser modules mounted independently on a first movable support common to both, with the possibility of regulating the separation between them. The multi-laser head is associated with a horizontal sliding carriage with the intermediation of vertically displaceable brackets.

Each laser module incorporates a laser resonator that emits a laser beam whose focal point is located in the vertical plane equidistant between the axes of rotation of the traction rolls. This data is highly relevant since in this way the laser beam perpendicularly impacts on the bottom of the alveoli without generating dark areas in which the light radiation does not arrive with sufficient power limiting its ability to detach and volatilize the slag. Another device incorporated in the laser module is a suction element formed by a vertical tube connected to a flexible hose that at its distal end is connected to a common aspiration system terminated in a nozzle facing the focal point of the laser beam.

The multi-laser head generates two or more laser focal points, so that one pass or sweep of the head is equivalent to two or more sweeps of a conventional laser machine, being necessary less sweeps to reach the same level of cleaning. This results in operating times of at least 45% less to a same frequency and power of resonator.

Another novel aspect of the invention refers to the incorporation of means capable of stopping the cleaning operation when the rotation of the anilox is not stable or is stopped accidentally.

Concretely, these means consist of a palpate wheel constituted by one of the free rollers of the bed or mounted on a second movable support that is sited between the traction rollers of the bed. The palpate wheel is associated with an encoder or other motion detector that is linked to the electronic system of the machine and in particular to the emergency stop system.

The operation mode is simple and effective: when placing the anilox roller between the traction rollers, it comes into contact with the palpate wheel or with the free rollers of the bed. When the traction rollers rotate the anilox roller, this, in turn, rotates the tracer wheel that can only rotate due to the movement of the anilox. Under these conditions, the palpate wheel drives the encoder or motion detector that sends its telemetry to the operator of the system that determines the existence of movement and its characteristics. If, with the active traction rollers, the movement detected in the anilox is not as expected, or no movement is detected, the electronic system assumes an irregular situation and performs an emergency stop of the multi-laser head, preventing the laser beams damaging the surface of the cylinder by overexposure.

Given the importance of this system, its integration into the machine will preferably be done redundantly.

Another novel aspect of the invention refers to a method and means of auto-adjusting the laser focal point to the diameter of the anilox, capable of accurately detecting the diameter of the anilox roll without the need for operator intervention, and based on the detected measurement, move the multi-laser head to the proper position to match the focal point of the laser beam to the surface of the anilox roller.

These means are constituted by a detection element that determines the position of the second displaceable support of the palpate wheel, or of a specific support for this function, which is sited between the traction rollers of the bed and is displaced by the anilox roller when the palpate wheel or a specific wheel comes into contact with its surface.

The new procedure for the auto-adjustment of the laser focal point to the diameter of the anilox is based on the premise that, in the self-adjusting means incorporated, the displacement of the second displaceable support is proportional to the diameter of the anilox roller; more pronounced to smaller the diameter of the anilox roll, so that, by measuring said displacement, the diameter of the anilox roll can be deduced, and the distance to be traversed by the multi-laser head can be calculated until it is placed at the appropriate height on the anilox to develop its function.

The operation is as follows: by placing the anilox roller between the traction rollers, the latter comes into contact with the tracer wheel and pushes it, lowering the second movable support along its guides to a stable position.

Then the detection element measures the section descended by the second movable support and said telemetry is received by the electronic system of the machine which, based on these data and the known variable corresponding to the focal length of the laser beam, extrapolates the distance that the multi-laser head must be moved so that the focal point is located on the surface of the anilox roller, then maneuvering the servomotors of the micrometric shafts to place the multi-laser head in the proper position.

Figure 1:
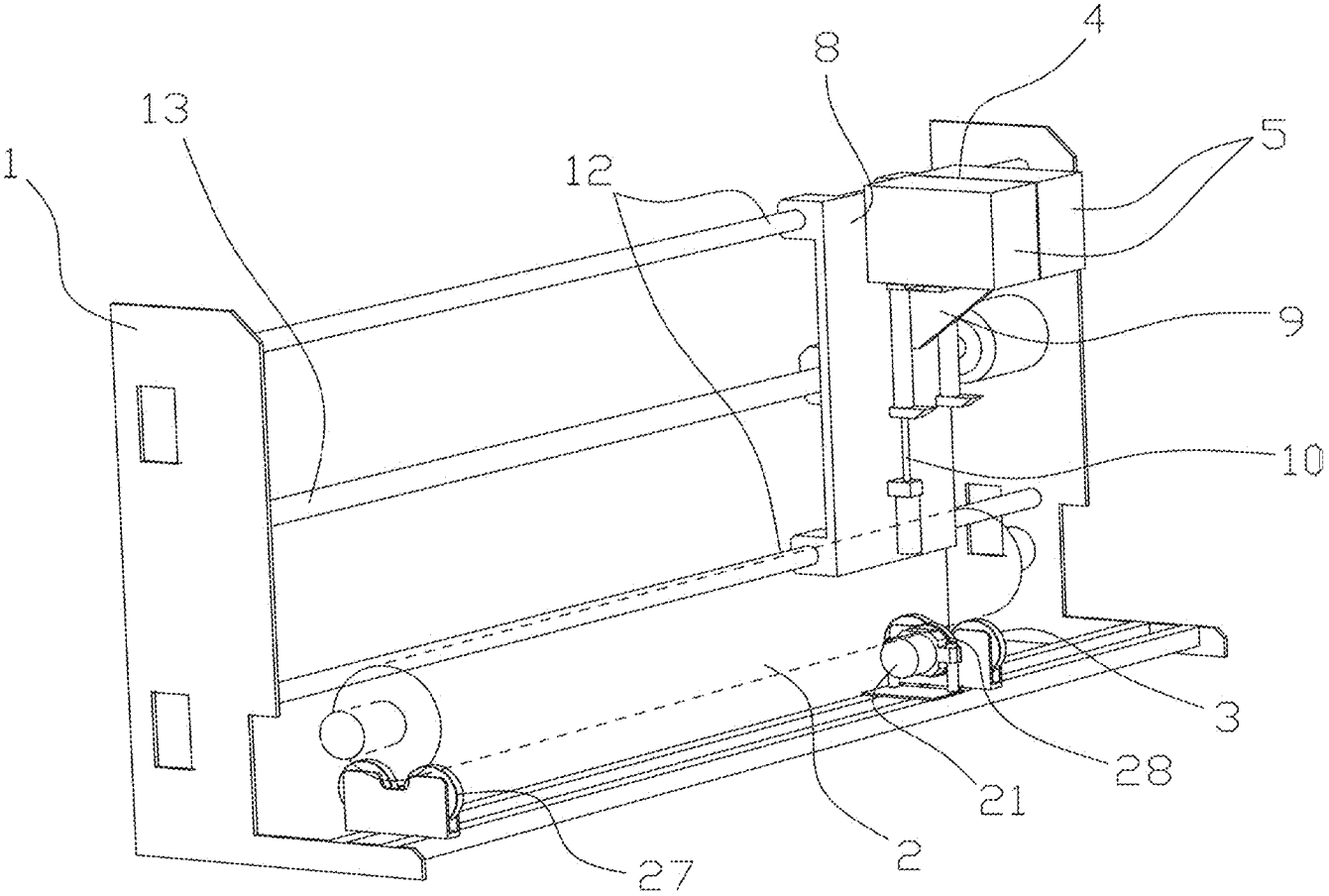
FIG. 1 represents a perspective view of the machine in which can be seen the assembly of its components and an anilox roller in the cleaning position in a configuration in which the palpate wheel fulfills double function as a detector element of rotation of the anilox roller and as a component in the auto-adjustment means of the laser focal point.
Figure 2:
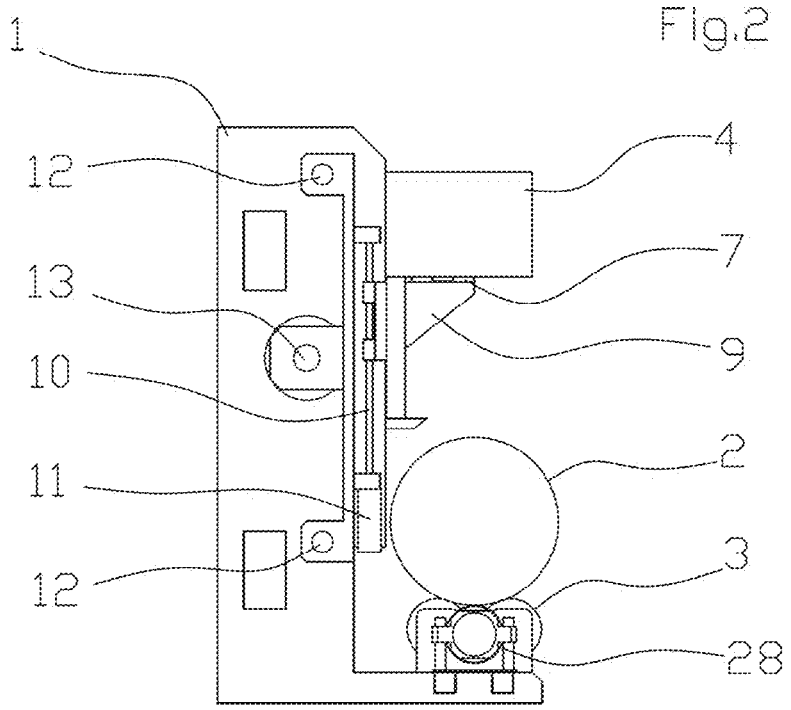
FIG. 2 shows a side view of the machine with an anilox roller of the maximum admissible diameter.
Figure 3:
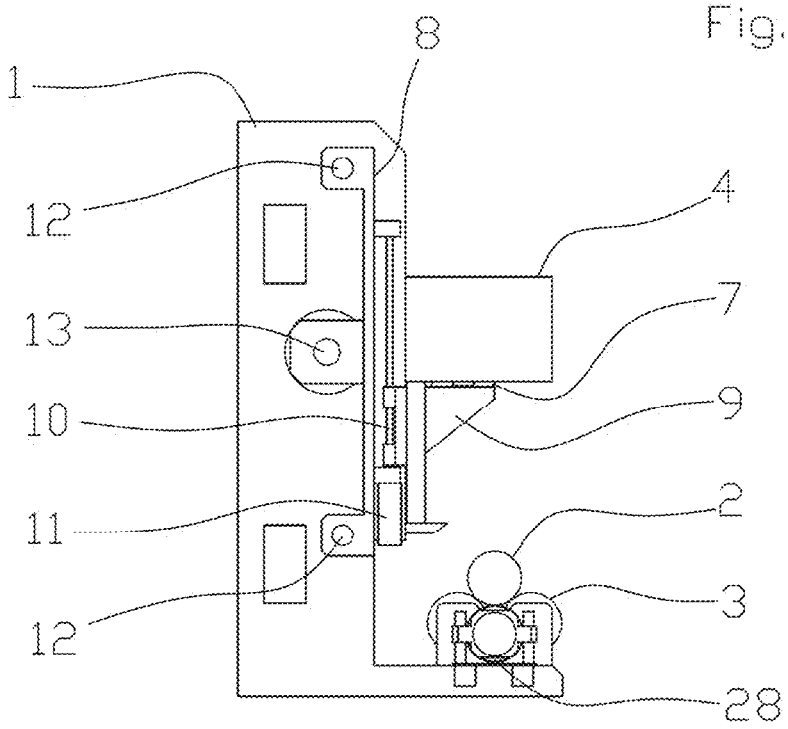
FIG. 3 represents a side view of the machine with an anilox roll of the minor admissible diameter.

The differences of position of the components of the machine observable between FIG. 2 and FIG. 3, show that the diameter of the anilox roller is proportional to the displacement of the support of the palpate wheel.

Figure 4:
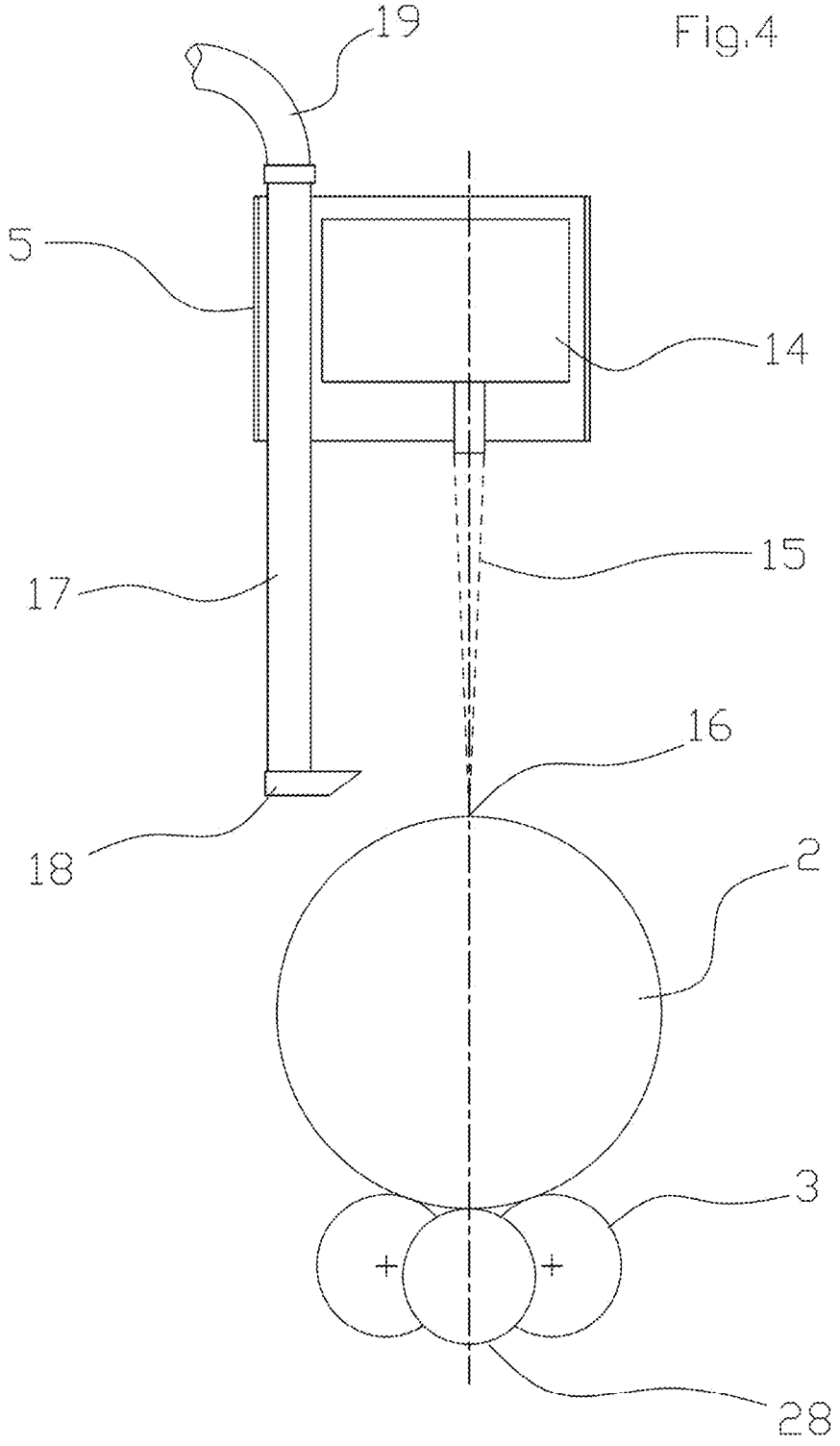

FIG. 4 represents a schematic view of a laser module and the geometry of the laser beam generated.

Figure 5:
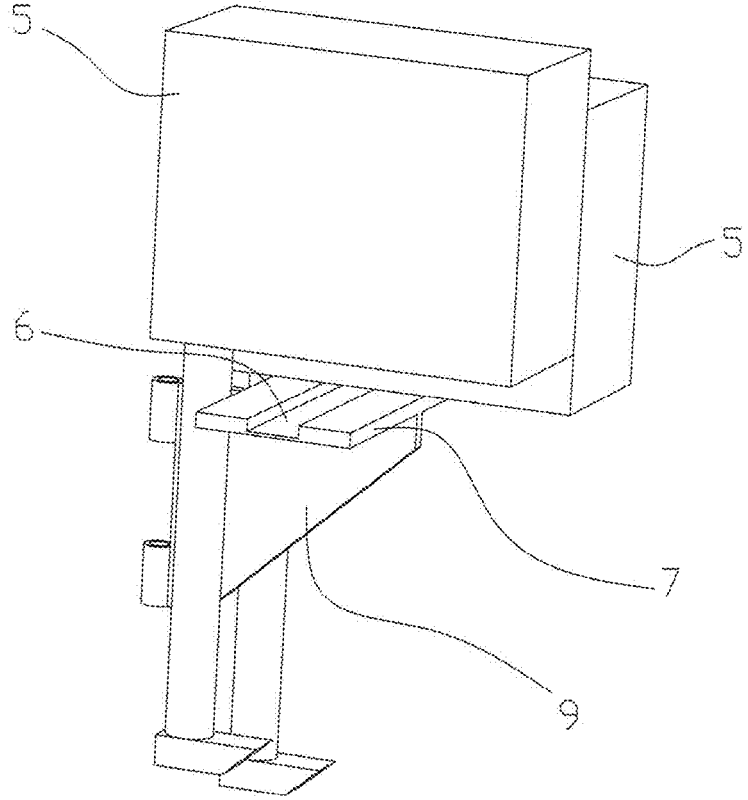

FIG. 5 represents a multi-laser head of two laser modules in its support.

Figure 6:
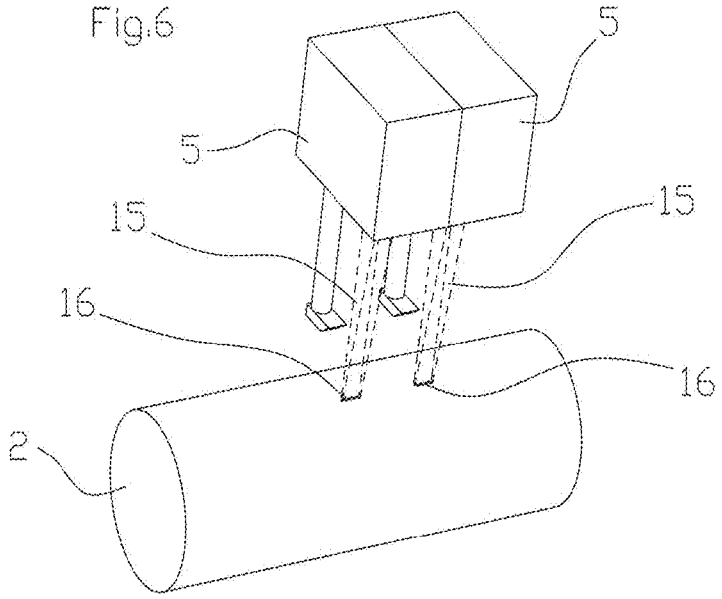
Figure 7:
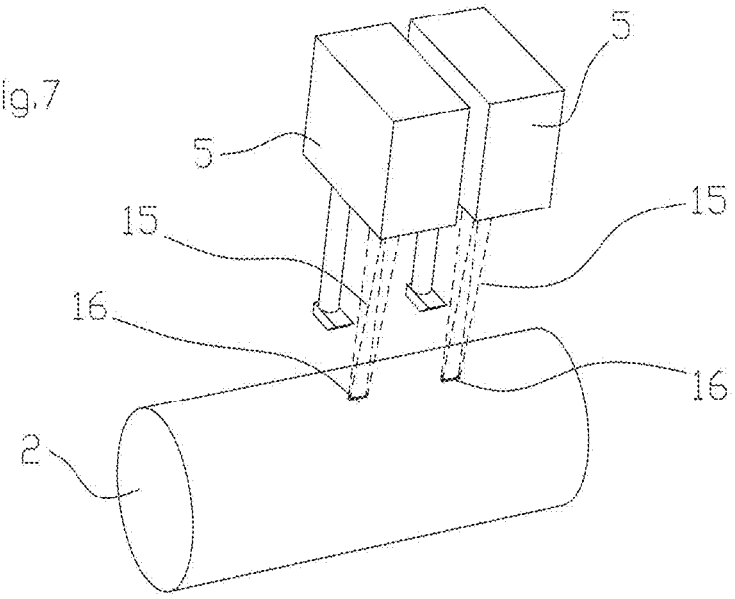

FIGS. 6 and 7 represent the scheme of a multi-laser head of two laser modules, in which the two generated laser beams can be seen, where the example of FIG. 6 presents the position of minimum distance between laser focal points, while in the example of FIG. 7 distance between the focal points is maximum.

Figure 8:
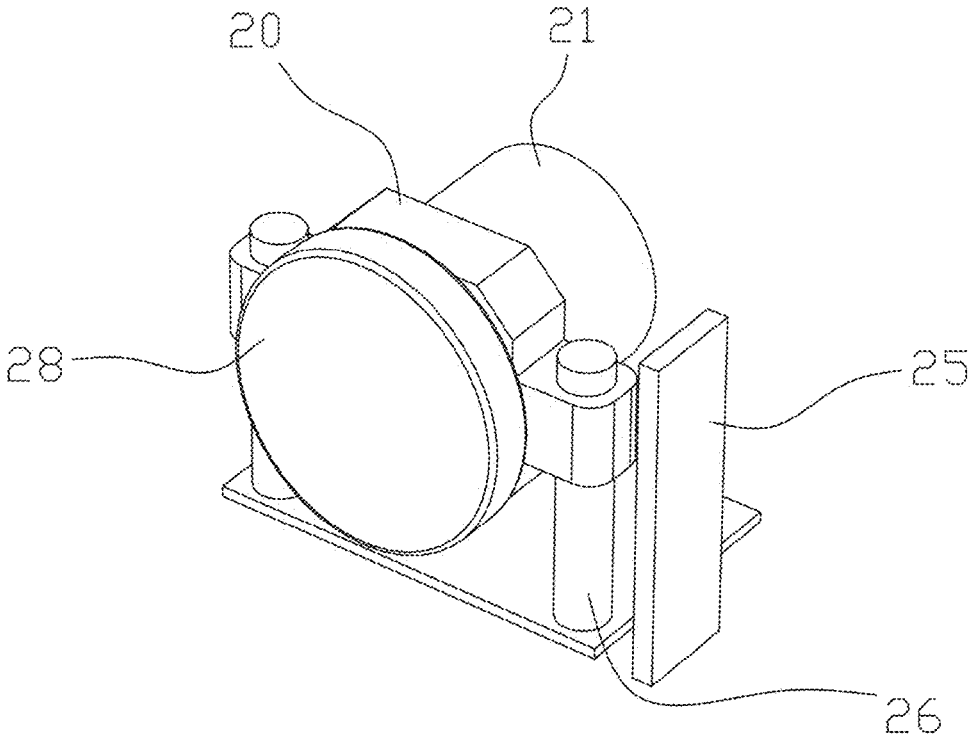

FIG. 8 shows a detailed view of the feeler wheel mounted in the second movable support.

Figure 9:
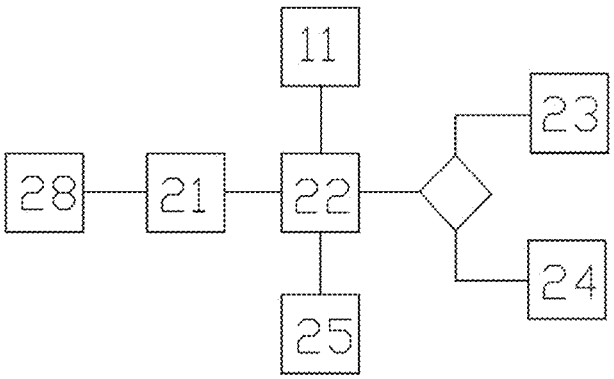

FIG. 9 corresponds to an operating scheme of the safety means capable of stopping the cleaning operation when the rotation of the anilox is not stable or stopped accidentally and of the means of auto-adjustment of the laser focal point to the diameter of the anilox roller.

Figure 10:
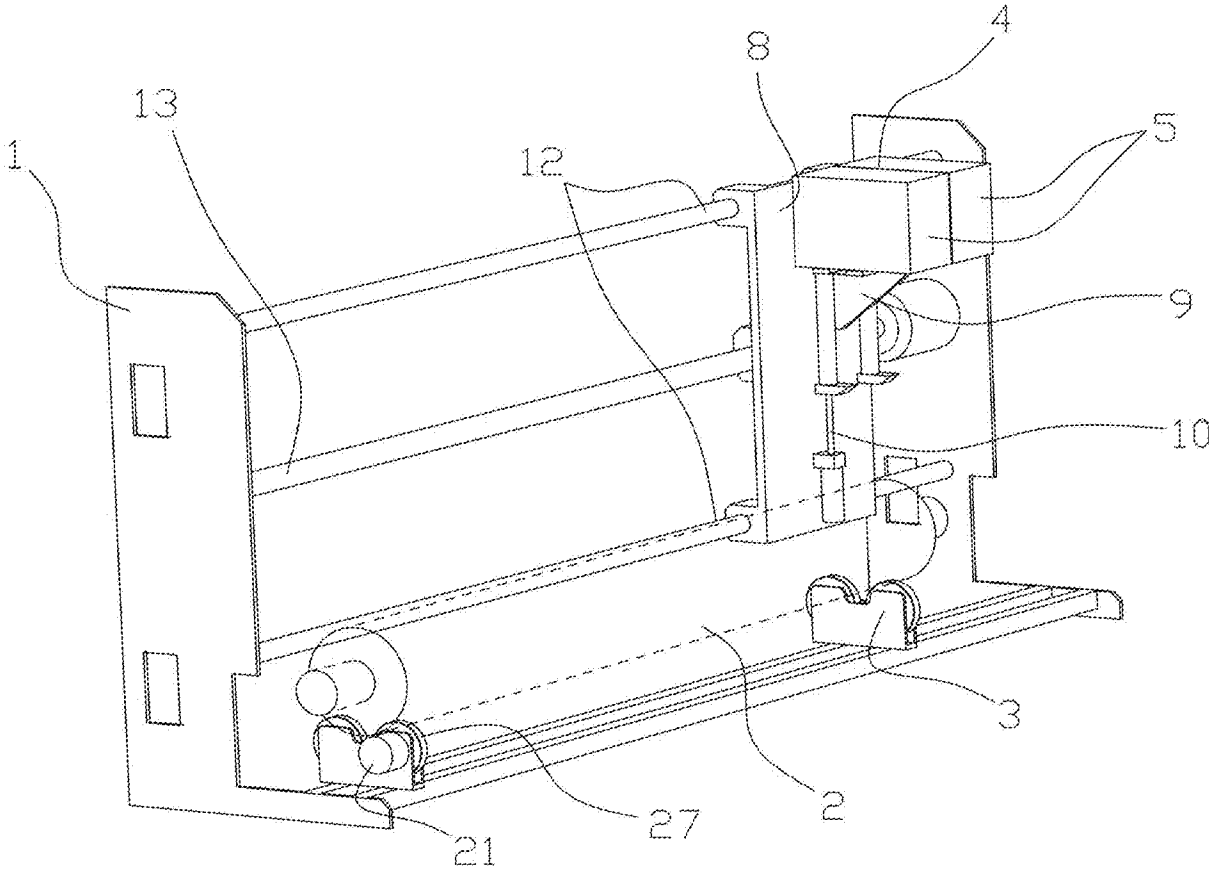

FIG. 10 represents a perspective view of the machine in which the assembly of its components and an anilox roller in the cleaning position in a configuration in which the palpate wheel is constituted by one of the free rollers can be seen.

LIST OF REFERENCES

1—Mechanical structure
2—Anilox roller
3—Traction rollers
4—Multi-laser head
5—Laser module
6—Horizontal guide
7—First movable support
8—Horizontal sliding carriage
9—Brackets
10—Vertical axis micrometric
11—Servomotors
12—Carriage guides
13—worm
14—Laser resonator
15—Laser beam
16—Focal point
17—Vertical tube
18—Nozzle
19—Flexible hose
20—Second movable support
21—Encoder
22—Electronic system
23—Emergency stop
24—Operating status
25—Detection element
26—Guide
27—free rolls
28—Palpate wheel

DESCRIPTION OF A PREFERRED CONSTRUCTION

This invention consists of ones improvements introduced in cleaning machines of anilox rollers that are made up of a mechanical structure (1) that fixes all the elements of the machine and where the anilox roller (2) sits on a bed formed by two traction rollers (3) and other free rollers (27).

This mechanical structure has a multi-laser head (4) consisting of two laser modules (5) mounted on a horizontal guide (6) of a first movable support (7).

The multi-laser head (4) is associated with a horizontal sliding carriage (8) with the intermediation of vertically displaceable brackets (9).

The horizontal sliding carriage (8) runs parallel to the anilox roller (2) following carriage guides (12) integral with the mechanical structure (1) and driven by a worm (13) motorized.

The brackets (9) are coupled to vertical micrometric axes (10) arranged on the horizontal sliding carriage (8) and driven by servomotors (11), so that, depending on the rotation of the micrometric axes left or right, the first movable support (7) with the multi-laser head (4), will ascend or descend controlled.

The servomotors (11) are operatively connected to the electronic system of the machine (22), from where they are commanded.

Each laser module (5) incorporates a laser resonator (14) that emits a laser beam (15) whose focal point (16) is located in the vertical plane equidistant between the axis of rotation of the traction rollers (3). It also incorporates a suction element formed by a vertical tube (17) connected to a flexible hose (19), terminated in a nozzle (18) oriented towards the focal point (16). This suction element absorbs the remains detached from the surface of the anilox roll by the action of the laser beam.

The multi-laser head (4) shown generates two contiguous focal points (16), the separation of the same can be modified moving the laser modules (5) along the guide (6) of the first movable support (7), establishing a position of maximum proximity (FIG. 6) and a position of maximum distancing (FIG. 7). The separation distance between focal points (16) allows to control the time of entry into action of the second laser scan.

Another novel aspect of the invention consists of the incorporation of a palpate wheel (19), mounted on a second movable support (20) movable by the guides (26) which is sited between the traction rollers (3) and which drags an encoder (21) operatively connected to the electronic system of the machine (22) and, in particular, to the emergency stop system (23).

The palpate wheel (19) comes into contact with the surface of the anilox roll (2) rotating with it and simultaneously pulling the encoder (21) that generates a telemetry received and analyzed by the electronic system of the machine (22).

While the system detects the existence of movement, the multi-laser head (4) remains in operative state (24).

If the system does not detect movement, or the movement detected is irregular, the emergency stop of the machine is activated (23).

Another novel aspect of the invention refers to the incorporation of auto-adjusting means of the laser focal point (16) to the diameter of the anilox roller (2).

These self-adjusting means consist in a detection element (25) that takes measurements of the displacement of the second movable support (20).

The detection element is operatively connected to the electronic system of the machine (22) that receives and analyzes the telemetry generated by the first one.

As the section descended by the second displaceable support (20) is proportional to the diameter of the anilox roller (2) deposited between the traction rollers (3), and the focal length of the laser beam is a known parameter, the electronic system of the machine (22) extrapolates the distance to be moved by the multi-laser head (4) so that the focal point (16) locate on the surface of the anilox roll (2), turning the servomotors (11) of the micrometric axes (10) to drive the multi-laser head (4) to that position.

The invention claimed is:

1. An anilox roller cleaning machine comprising:

a housing including inside:

an anilox roller supported on a bed having on a first end a first traction roller and a second traction roller, and on a second end a plurality of free rollers;

a horizontal sliding carriage running parallel to the anilox roller, the horizontal sliding carriage slides through carriage guides powered by a motor;

a vertical displaceable bracket connected to micrometric axes arranged on the horizontal sliding carriage, the vertical displaceable bracket is driven by a servomotor, the servomotor is operatively connected to an electronic system;

a multi-laser head connected to the horizontal sliding carriage by the vertical displaceable bracket, the multi-laser head is mounted on a horizontal guide of a first movable support which is connected to the horizontal sliding carriage, the multi-laser head including at least two laser modules, each one of the laser modules including:

a laser resonator that emits a laser beam having a focal point that is located in a vertical plane equidistant to the axes of rotation of the first and the second traction rollers and the anilox roller;

a suction device oriented towards the focal point of the laser beam, the suction device including a vertical tube having a flexible hose connected to a first end and a nozzle on a second end;

a rotation detector device for detecting rotation of the anilox roller, the rotation detector device including a palpate wheel mounted on a second movable support in contact with the anilox roller and connected to an encoder device, which is operatively connected to the electronic system;

wherein the rotation detector device, in the absence of movement or irregular movement, activates an emergency stop; and wherein depending on the rotation of the micrometric axes to a right side or a left side, the first movable support and the multi-laser head move up or down.

2. The anilox roller cleaning machine according to claim 1, further comprising self-adjusting devices for adjusting the laser focal point to the diameter of the anilox roller, the self-adjusting devices includes a detection element that takes measurements of the displacement of a second movable support associated with the palpate wheel.

3. A process for auto-adjustment of the laser focal point to a diameter of the anilox roller according to claim 1, wherein the focal length of the laser beam is a known parameter, the method comprising the steps of:

measuring a descended section by the second movable support, descended section is proportional to the diameter of the anilox roller placed between the first and the second traction rollers;

sending the measurement to the electronic system, extrapolating by using the electronic system the distance to be moved by the multi-laser head so the focal point is located on the surface of the anilox roller;

turning the servomotor of the micrometric axes to move the multi-laser head to the extrapolated distance to be moved.

* * * * *